US009698474B2

(12) United States Patent
Aubert et al.

(10) Patent No.: US 9,698,474 B2
(45) Date of Patent: Jul. 4, 2017

(54) COMPACT HELICAL ANTENNA WITH A SINUSOIDAL PROFILE MODULATING A FRACTAL PATTERN

(71) Applicants: Centre National de la Recherche Scientifique (CNRS), Paris (FR); CENTRE NATIONAL D'ETUDES SPATIALES, Paris (FR)

(72) Inventors: Hervé Aubert, Toulouse (FR); Hubert Diez, Leguevin (FR); Daniel Belot, Leguevin (FR); Alexandru Takacs, Toulouse (FR)

(73) Assignees: Centre National de la Recherche Scientifique (CNRS) (FR); CENTRE NATIONAL D'ETUDES SPATIALES (FR)

( * ) Notice: Subject to any disclaimer, the term of this patent is extended or adjusted under 35 U.S.C. 154(b) by 0 days.

(21) Appl. No.: 14/386,566

(22) PCT Filed: Mar. 21, 2013

(86) PCT No.: PCT/EP2013/055979

§ 371 (c)(1),
(2) Date: Sep. 19, 2014

(87) PCT Pub. No.: WO2013/139935

PCT Pub. Date: Sep. 26, 2013

(65) Prior Publication Data

US 2015/0048996 A1 Feb. 19, 2015

(30) Foreign Application Priority Data

Mar. 21, 2012 (FR) ..... 12 52547

(51) Int. Cl.
*H01Q 1/36* (2006.01)
*H01Q 11/08* (2006.01)

(52) U.S. Cl.
CPC ..... *H01Q 1/362* (2013.01); *H01Q 11/08* (2013.01)

(58) Field of Classification Search
CPC ..... H01Q 1/362
(Continued)

(56) References Cited

U.S. PATENT DOCUMENTS

2004/0017317 A1* 1/2004 Schmiade ..... H01Q 1/36 343/700 MS
2006/0164306 A1* 7/2006 Chang ..... H01Q 1/38 343/700 MS (Continued)

FOREIGN PATENT DOCUMENTS

FR 2916581 A1 11/2008

OTHER PUBLICATIONS

Takacs A et al., "Miniaturization of quadrifilar helix antenna for VHF band applications", Antennas & Propagation Conference, 2009. LAPC 2009. Loughborough, IEEE, Piscataway, NJ, USA, Nov. 16, 2009, pp. 597-600, XP031579617, ISBN: 978-1-4244-2720-8.

(Continued)

*Primary Examiner* — Hoanganh Le
(74) *Attorney, Agent, or Firm* — Lerner, David, Littenberg, Krumholz & Mentlik, LLP

(57) ABSTRACT

The invention concerns a helical antenna comprising a shape of revolution and a plurality of radiating strands helically wound around the shape of revolution, characterized in that each radiating strand is defined by a repetition of a fractal pattern comprising segments formed by a sinusoidal curve.

7 Claims, 4 Drawing Sheets

Figure 2:
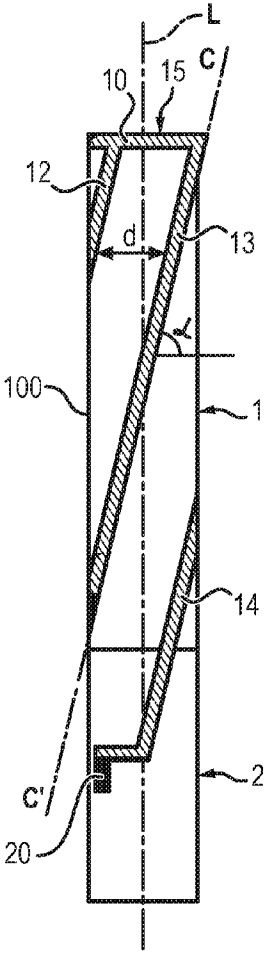
FIG. 2 (PRIOR ART)

(58) Field of Classification Search
USPC ..... 343/895, 700 MS
See application file for complete search history.

(56) References Cited

U.S. PATENT DOCUMENTS

| | | | | |
|---|---|---|---|---|
| 2010/0156752 | A1* | 6/2010 | Fonseca | H01Q 1/362 343/895 |
| 2010/0194665 | A1* | 8/2010 | Hanane | H01Q 11/08 343/895 |

OTHER PUBLICATIONS

Letestu Y et al., "A size reduced configurations of printed quadrifilar helix antenna", 2005 IEEE International Workshop on Antenna Technology, IEEE IWAT 2005, Marina Mandarin Hotel Singapore, Mar. 7-9, 2005, IEEE Opperations Center, Piscataway, NJ, DOI 10.1109/IWAT.2005.1461082, ISBN: 978-0-7803-8842-0.

Hanane L et al., "Compact printed quadrifilar helix antennas for stratospheric balloons telemetry", Antennas and Propagation International Symposium, 2007 IEEE, IEEE, Piscataway, NJ, USA, Jun. 1, 2007, pp. 1525-1528, XP031169441, ISBN: 978-1-4244-0877-1.

Hebib S et al., "Compact Printed Quadrifilar Helical Antenna With Iso-Flux-Shaped Pattern and High Cross-Polarization Discrimination", IEEE Antennas and Wireless Propagation Letters, IEEE, Piscataway, NJ, USA, vol. 10, Jan. 1, 2011, pp. 635-638, XP011402979, ISSN: 1536-1225, DOI 10.1109/LAWP.2011.2159189.

International Search Report & Written Opinion for Application No. PCT/EP2013/055979 dated May 21, 2013.

Preliminary Search Report for Application No. FR1252547 dated Nov. 14, 2012.

* cited by examiner

MR1
β
A
A'

F1
A
A'

F'1
A
A'

MR2
β
A
A'

F2
A
A'

F'2
A
A'

MR3
A
A'

F3
A
A'

F'3
A
A'

MR4
β
A
A'

F4
A
A'

MR5
β
A
A'

F5
A
A'

COMPACT HELICAL ANTENNA WITH A SINUSOIDAL PROFILE MODULATING A FRACTAL PATTERN

CROSS REFERENCE TO RELATED APPLICATIONS

The present application is a national phase entry under 35 U.S.C. §371 of International Application No. PCT/EP2013/055979, filed Mar. 21, 2013, published in French, which claims priority from French Patent Application No. 1252547, filed Mar. 21, 2012, the disclosures of which are incorporated by reference herein.

GENERAL TECHNICAL FIELD

The invention relates to helical type antennas. In particular, it relates to quadrifilar printed helical type antennas. Such antennas find application particularly in L-band telemetry systems (operating frequency comprised between 1 and 2 GHz, typically around 1.5 GHz) for stratospheric balloon payloads.

PRIOR ART

Helical type printed antennas have the advantage of being of simple and low-cost manufacture.

They are particularly suited to circularly polarized L-band telemetry signals, signals used in stratospheric balloon payloads.

They offer a good axial ratio, hence good circular polarization over a wide range of elevation angles.

Patent EP 0320404 described a printed helical type antenna and its manufacturing process.

Such an antenna includes four radiating strands in the form of metal strips obtained by removing metal cladding material on either side of the bands of a metal-clad of a printed circuit. The printed circuit is designed to be coiled in a spiral around a cylinder.

These antennas, however, while offering good performance, are bulky.

Compact helical type antennas, including meandering radiating strands, have been proposed for reducing the size of antennas of this type.

The article: Y. Letestu, A. Sharaiha, Ph. Besnier "*A size reduced configuration of printed quadrifilar helix antenna", IEEE workshop on Antenna Technology: Small Antennas and Novel Metamaterials*, 2005, pp. 326-328, March 2005, describes such compact antennas.

However, even though a gain on the order of 35% (reduction in height) in bulk has been obtained, the performance, particularly in crossed polarization and in back radiation, is degraded, showing the limits of the use of such patterns when it comes to reducing the size of antennas of this type.

Document FR 2 916 581 describes a helical type antenna including radiating strands consisting of the repetition of a fractal pattern.

However, the use of these patterns does not allow a significant reduction in the size of the antenna.

In addition, fractal patterns consisting of rectilinear segments have a much smaller number of degrees of freedom which the designer can employ to as to adjust and optimize the performance of the compact antenna. Moreover, at a given antenna height, far fewer solutions comprising these patterns exist.

PRESENTATION OF THE INVENTION

The invention makes it possible to reduce the bulk of helical antennas of known type and in particular to reduce the height of such antennas.

To this end, according to a first aspect, the invention relates to a helical type antenna having a rotational shape and a plurality of radiating strands, characterized in that each radiating strand is defined by the repetition of a fractal pattern comprising segments consisting of a sinusoidal curve.

The invention is advantageously supplemented by the following features, taken alone or in any technically possible combination:

- each segment corresponds to a half-period of a sinusoidal curve defined by $$y(x) = S \cdot k \cdot L' \cdot \sin\left(\frac{\pi}{L'} \cdot x\right),$$

where: S is an integer with a value within $\{-1; +1\}$, k is the ratio of the amplitude of the sinusoid and its half-wavelength;
- each segment of the fractal pattern has an identical length;
- the fractal is of the von Koch type, wherein each straight line is replaced by a sinusoidal segment;
- each of the radiating strands consists of a defined metal-clad zone, wrapped in a spiral on the lateral surface of a sleeve such that the director axis of each strand is separated by a specified distance from the axis of the following strand, defined along any perpendicular to any director line of the sleeve as the distance between two points, each defined by an intersection between the axis of the strand and a perpendicular to any director line of the sleeve;
- the rotational shape is cylindrical or conical;
- the antenna includes four identical radiating strands:
- the length of an uncoiled strand is on the order of $$k \cdot \frac{\lambda}{4},$$

where $\lambda$ is the operating wavelength of the antenna.

PRESENTATION OF THE FIGURES

Figure 1:
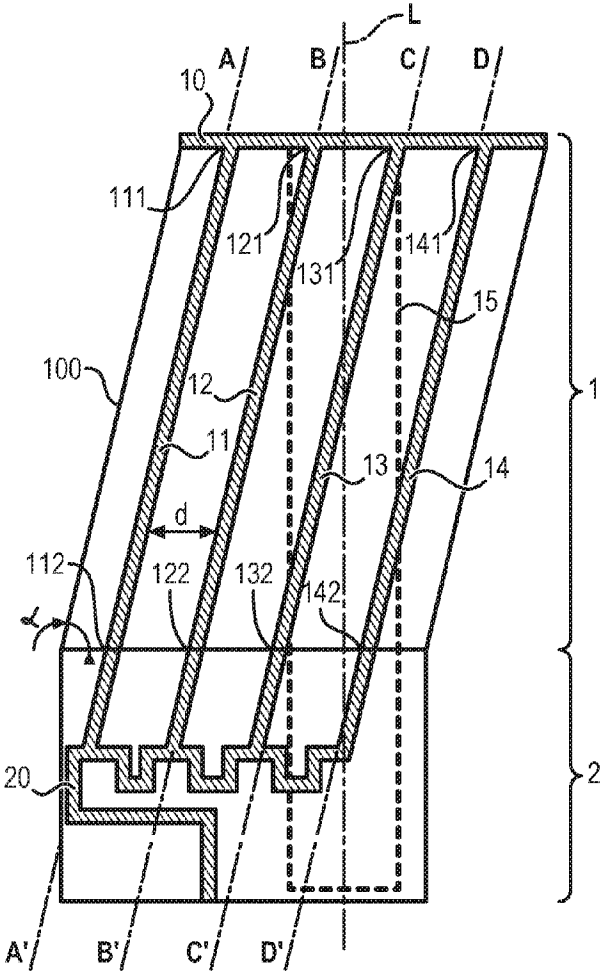
FIG. 1 (PRIOR ART)
Figure 3A:
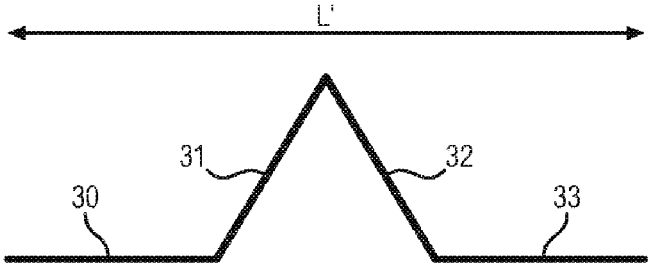
Figure 3B:
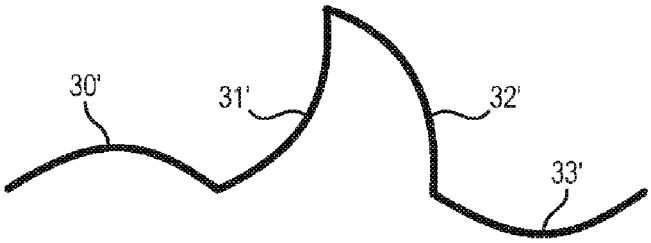
Figure 3C:
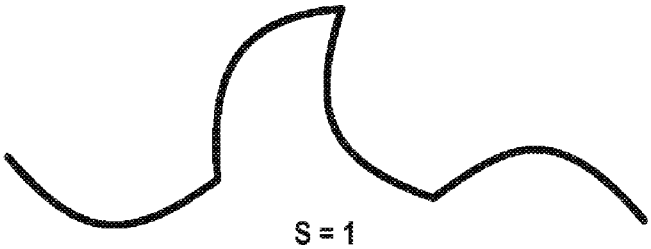
Figures 4A, 4B, 4C, 5A, 5B, 5C, 6A, 6B, 6C, 7A, 7B, 8A, 8B:
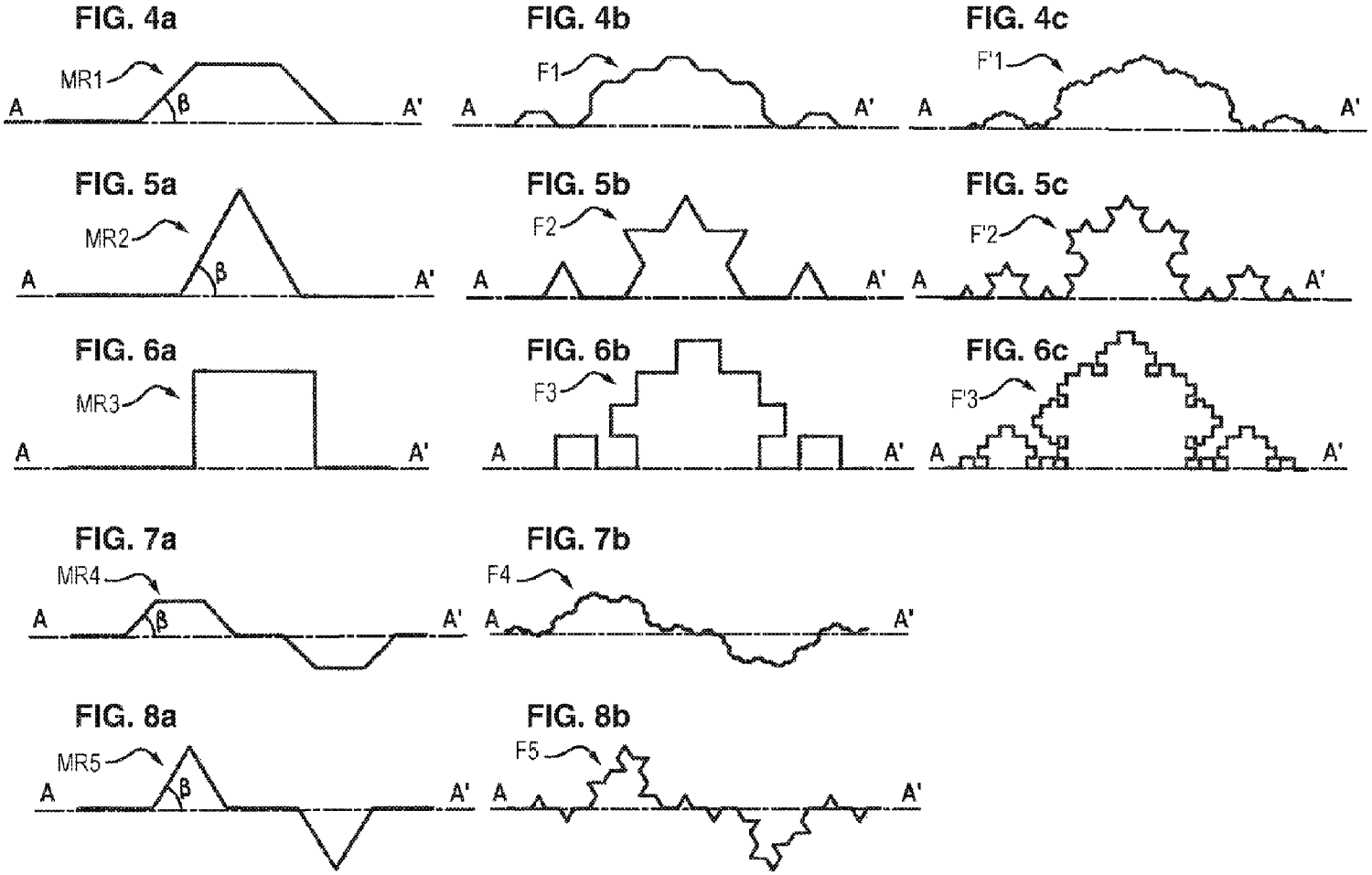
Figure 9A:
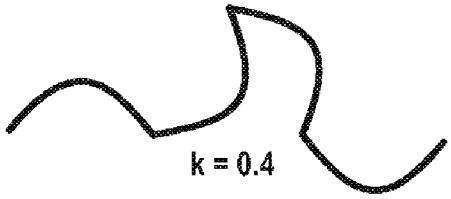
Figure 9B:
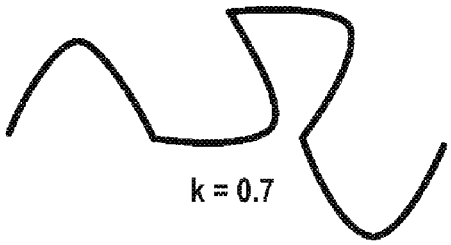
Figure 9C:
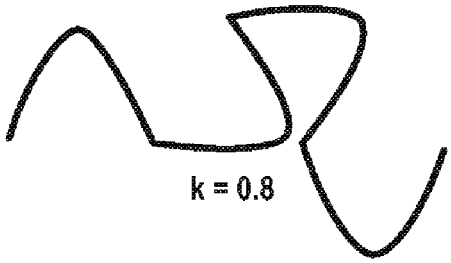
Figure 10:
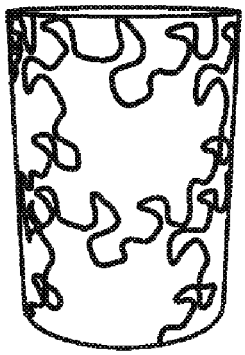

Other features and advantages of the invention will appear from the description that follows, which is purely illustrative and not limiting and must be read with reference to the appended drawings wherein FIG. 1 illustrates schematically, in developed form, a helical antenna of known type including rectilinear radiating strands;

FIG. 2 illustrates schematically a front view of a helical antenna of known type including rectilinear radiating strands;

FIGS. 3*a*, 3*b* and 3*c* illustrate a von Koch type reference pattern with rectilinear segments and with segments consisting of a sinusoidal curve;

FIGS. 4*a*, 4*b* and 4*c* illustrate, respectively, a first reference pattern, a fractal of order 1, a fractal of order 2 and a fractal of order 3;

FIGS. 5*a*, 5*b* and 5*c* illustrate respectively a second reference pattern, a fractal of order 1, a fractal of order 2 and a fractal of order 3;

FIGS. 6*a*, 6*b* and 6*c* illustrate respectively a third reference pattern, a fractal of order 1, a fractal of order 2 and a fractal of order 3;

FIGS. 7*a* and 7*b* illustrate respectively a fourth reference pattern, a fractal of order 1 and a fractal of order 2;

FIGS. 8*a* and 8*b* illustrate respectively a reference pattern, a fractal of order 1 and a fractal of order 2 for radiating strand patterns, according to a fifth embodiment;

FIGS. 9*a*, 9*b*, 9*c* illustrate a von Koch type reference pattern with segments consisting of a sinusoidal curve according to several embodiments:

FIG. 10 illustrates an embodiment of a helical type antenna according to the invention.

DETAILED DESCRIPTION OF THE INVENTION

General Structure of the Antenna

FIGS. 1 and 2 illustrate respectively a developed view and a front view of a helical antenna including four radiating strands coiled into a spiral.

Such an antenna includes two parts 1, 2.

Part 1 includes a conductive zone 10 and four radiating strands 11, 12, 13 and 14.

On part 1, the helical type antenna includes four radiating strands 11, 12, 13, 14 coiled in a spiral in a rotational shape around a sleeve 15, for example.

On this part, the strands 11-14 are connected, on the one hand, in short-circuit at a first end 111, 121, 131, 141 of the strands to the conductive zone 10 and, on the other hand, at a second end 112, 122, 132, 142 of the strands, to the feeder circuit 20.

The radiating strands 11-14 of the antenna can be identical and are for example four in number. In this case, the antenna is quadrifilar.

The sleeve 15 onto which the antenna is coiled is shown dotted in FIG. 1 to constitute the antenna as shown in FIG. 2.

The radiating strands 11-14 are oriented in such a way that a support axis AA', BB', CC' and DD' of each strand forms an angle $\alpha$ with respect to any plane orthogonal to any director line L of the sleeve 15.

This angle $\alpha$ corresponds to the helical coiling angle of the radiating strands.

Each of the radiating strands 11-14 consists of a metal-clad zone.

In FIGS. 1 and 2, the metal-clad zones of part 1 are strips symmetrical with respect to a director axis AA', BB', CC', DD' of the strands.

The distance d between two consecutive strands is defined along any perpendicular to any director line L of the sleeve 15 as the distance between two points, each defined as the intersection of said perpendicular with an axis of the strands.

For example, to obtain a symmetrical quadrifilar antenna, this distance d will be set to one quarter of the perimeter of the sleeve 15.

The substrate supporting the metal strips is coiled in a spiral onto the lateral surface of the sleeve 15.

According to one embodiment of such an antenna, the two parts 1, 2 are formed on a printed circuit 100.

The radiating strands 11-14 are then metal strips obtained by removing material on either side of the strips of a metal-clad zone, on the surface of the printed circuit 100.

The printed circuit 100 is designed to be coiled around a sleeve 15 having a general rotational shape, such as a cylinder or a cone for example.

Part 2 of the antenna includes a feeder circuit 20 of the antenna.

The feeder circuit 20 of the antenna consists of a meandering transmission line of the ribbon line type, providing both the function of distributing the feed and adaptation of the radiating strands 11-14 of the antenna.

Feeding of the radiating elements is accomplished at equal amplitudes with a quadrature phase progression.

Reduction of the size of helical type antennas such as those shown in FIGS. 1 and 2 is obtained by using, for the radiating strands of part 1 of the antenna, particular patterns which will be described below. Part 2, of the antenna, for its part, is of known type and will not be further detailed.

Patterns of the Radiating Strands

The radiating strands consist of a fractal comprising segments consisting of a sinusoidal curve.

An elementary element of the fractal pattern is called a segment.

FIG. 3*a* illustrates a reference pattern of a von Koch type fractal comprising three elementary elements 30, 31, 33. Such a pattern is a fractal of order 1. In FIG. 3*a*, the elementary element is a rectilinear segment.

Fractals have the property of self-similarity; they consist of copies of themselves at different scales. These are self-similar and very irregular curves.

A fractal consists in particular of reduced replicas of the reference pattern.

A fractal is generated by iterating steps consisting of reducing the reference pattern, then applying the pattern obtained to the reference pattern. Higher orders are obtained by applying to the center of each segment of the reference pattern the same reduced reference pattern, and so on.

The reference pattern can be simple or alternating with respect to a director axis of the pattern.

The selection of the pattern itself is guided by the radiation performance of the antenna.

For generating a von Koch type fractal, reference can be made to http://www.mathcurve.com/fractals/koch/koch.shtml.

To reduce the height of the antenna while maintaining the same operating frequency (resonance), each rectilinear segment of the fractal pattern is replaced by a sinusoidal segment.

Such a replacement makes it possible to increase the expanded length of the radiating strand for a given height, or to reduce the height of the antenna for a given expanded length.

The resonant frequency of the antenna is set by the expanded length of the radiating strands. This expanded length depends on the parameters of the helix (height, radius and number of turns) and on the geometry of the pattern employed.

FIG. 3*b* illustrates a reference pattern used for the strands of the helical antenna, each segment 30', 31', 32', 33' of the fractal pattern consisting of a sinusoidal segment.

In the case of FIG. 3*a*, it is a first-order von Koch type fractal pattern consisting of four rectilinear segments of identical length (L'/3, L' being the "horizontal" length of the pattern). In the case of FIG. 3*b*, each segment of length L'/3 of the von Koch pattern (that of FIG. 3*a*) is replaced by a sinusoidal segment (i.e. a half-period of a sinusoid).

All the segments of the pattern have the same length.

A fractal pattern is defined by three parameters:

the size of each repetition of the reference pattern (order 1 of the fractal pattern):

the number of repetitions which is called the number of cells;

the iteration of the fractal, which is called the order of the fractal.

In addition, the strand of the antenna is defined by the following parameters:

the deployed length;

the angle α corresponding to the helical coiling angle of the radiating strand;

the length of the cell L.

The sinusoid which defines the fractal profile can in particular be defined by the following functional $$y = S \cdot k \cdot L' \cdot \sin\left(\frac{\pi}{L'} \cdot x\right)$$

where: S is an integer with a value within {−1; +1}, constant over a segment, k is the ratio of the amplitude of the sinusoid and its half-wavelength (half-period). Thus, as will be understood, the sinusoid modulating the fractal pattern is defined over one period.

In FIG. 3*b*, the pattern is such that S=+1 while in FIG. 3*c* the pattern is such that S=−1.

Thus this reference pattern consists of a succession of alternating sinusoidal arcs constituting a fractal pattern.

The function can be defined segment by segment, or by adopting a curvilinear coordinate along the pattern.

In the case of FIG. 3*b*, the functional defined above was applied by sections of two segments (segments 30, 31 on the one hand and segments 32, 33 on the other hand).

In the case of FIG. 3*a*, the central segments form a 60° angle. To obtain the pattern of FIG. 3*b*, the functional is first applied to two rectilinear segments and they are oriented at 60°. A pattern for different values of k for S=+1 is illustrated in FIGS. 9*a*, 9*b* and 9*c*.

The parameter k makes it possible to increase the expanded length for each corresponding segment of the von Koch fractal: instead of having a short rectilinear segment, there is a sinusoidal segment with a greater expanded length. The greater the amplitude of the sinusoid, the greater is the expanded length. It is however necessary to avoid overlapping radiating strands when k takes on excessive values.

It is also possible to contemplate other types of fractal pattern wherein each segment is replaced by a sinusoidal curve.

FIGS. 4*a*, 5*a*, 6*a*, 7*a* and 8*a* illustrate a reference pattern (fractal of order 1), the segments whereof are rectilinear.

In FIG. 4*a*, the reference pattern is a triangle wherein the base is eliminated.

In FIG. 5*a*, the reference pattern is a square wherein the base is eliminated.

In FIG. 6*a*, the reference pattern includes two opposed isosceles trapezoids with spacing equal to the width of the short base, wherein the long base has been eliminated. The angle θ between a side extending from the short base toward the long base.

In FIG. 7*a*, the reference pattern includes two equilateral triangles, with spacing equal to the width of a side, wherein the base has been eliminated.

FIGS. 4*b*, 5*b*, and 6*b*, 7*b* and 8*b* illustrate respectively order 2 of a fractal pattern following an iteration of the reference patterns of FIGS. 4*a*, 5*a*, 7*a*, 8*a* respectively.

FIGS. 4*c*, 5*c*, 6*c* respectively illustrate order 3 of a fractal pattern following two iterations of the reference patterns of FIGS. 4*a*, 5*a*, 6*a*.

In the case of certain patterns, particularly those of the type shown in FIGS. 4*a*, 6*a* and 7*a*, crossings between lines of one and the same cell are possible.

To avoid such crossings, the angle β can be adjusted (see FIGS. 4*a*, 6*a* and 7*a*).

The angle β is the angle between the first inclined segment and the eliminated base.

Adjustment of this angle β allows a reduction in the length of the strands.

In the case of a von Koch pattern there is, at order 1, a ratio of the expanded length and the length of the pattern at order 1 of 4/3. At order 3, that ratio is (4/3)3, which is small.

To obtain a greater reduction, the angle β can be adjusted. The equilateral triangle of the von Koch pattern then becomes isosceles instead of being equilateral and the two triangle segments become longer than those of the initial equilateral triangle (with a constant length L'). The length is L'/(6.cos β) and the ratio of the expanded length to the length L' is given by $$\left(\frac{\frac{L'}{3} + 2\frac{L'}{6\cos\beta} + \frac{L'}{3}}{L'}\right)^{n} = \left(\frac{2\cos\beta + 1}{3\cos\beta}\right)^{n}$$

n being the order of the fractal curve. In this manner, it is possible to deploy a longer strand length within one and the same length. This reference pattern is called a "modified von Koch" pattern.

As before, each segment constituting the fractal patterns described above consists of a sinusoidal curve. For the sake of legibility, these patterns are not shown, but having seen the description above, a person skilled in the art understands how to arrive at the helical antenna the radiating strands whereof consist of a fractal pattern the segments whereof consist of a sinusoidal segment.

Embodiment Example and Performances

A helical type antenna including a von Koch type fractal the segments whereof were replaced by sinusoidal segments was made and tested. FIG. 10 shows an embodiment of such an antenna.

In particular, the performance of such an antenna was measured and compared to a quadrifilar type (reference) antenna having rectilinear strands, the antenna having a height of 514 mm.

The table below lists the different parameters used for the radiating strands. The base fractal is a von Koch pattern.

| Order | 1 | 1 | 1 | 1 | 1 | 2 | 2 | 2 |
|---|---|---|---|---|---|---|---|---|
| Number of cells | 3 | 3 | 3 | 3 | 4 | 2 | 2 | 3 |
| α (degrees) | 52 | 52 | 49 | 52 | 52 | 43 | 43 | 50 |
| Length of cell (mm) | 155 | 150 | 140 | 135 | 108 | 250 | 243 | 190 |
| k | 0.5 | 0.5 | 0.7 | 0.7 | 0.7 | 0.7 | 0.7 | 0.7 |
| S | −1 | 1 | −1 | 1 | 1 | −1 | 1 | −1 |

-continued

| Order | 1 | 1 | 1 | 1 | 1 | 2 | 2 | 2 |
|---|---|---|---|---|---|---|---|---|
| Height (mm) | 285 | 276 | 252 | 249 | 265 | 205 | 198 | 254 |
| LHC (dB) | 0.88 | 0.952 | 0.8 | 0.97 | 0.95 | 0.15 | 0.202 | 0.93 |
| RHC (dB) | −10.3 | −10.2 | −10.3 | −11.8 | −10.8 | −10.2 | −11.1 | −10.0 |
| S11 (dB) | −6.1 | −6 | −6.9 | −6.9 | −6.3 | −6.2 | −6.3 | −6.2 |
| Effectiveness | 66 | 64 | 60 | 62 | 62 | 50 | 50 | 55 |
| Relative size (%) | 55.4 | 53.7 | 49 | 48.4 | 51.6 | 39.9 | 38.5 | 49.4 |
| Max gain (dB) | 2.44 | 2.41 | 1.91 | 2.23 | 2.26 | 0.37 | 0.36 | 1.6 |

A reduction is observed in the height of the antenna. In the above table, the relative size (%) is calculated as the ratio of the height of the compact antenna and the height of the reference antenna (514 mm).

In addition, it is observed that the best performance is obtained with the antenna based on the von Koch pattern with sinusoidal segments of order 2 and with two cells. This antenna has the same diagram at 137 MHz and at its resonant frequency (144 MHz). In addition, its height is 198 mm (relative size is 38.5%), that is a reduction of 61.5% of the height of the reference antenna.

The invention claimed is:

1. A helical type antenna having a rotational shape and a plurality of radiating strands coiled in a helix around the rotational shape, wherein each radiating strand is defined by a repetition of a fractal pattern comprising a sequence of segments, a sinusoidal curve having been applied on each segment of the sequence of the fractal pattern, so that each segment of each radiating strand corresponds to a half-period of a sinusoidal curve having a direction defined by the corresponding segment of the fractal pattern.

2. The helical type antenna according to claim 1, wherein each segment corresponds to a half-period of a sinusoidal curve defined by $$y(x) = S \cdot k \cdot L' \cdot \sin\left(\frac{\pi}{L'} \cdot x\right),$$

where: S is an integer with a value within $\{-1; +1\}$, k is the ratio of the amplitude of the sinusoid and its half-wavelength, L' is the horizontal width of the pattern.

3. The helical type antenna according to claim 1, wherein each segment of the fractal pattern has an identical length.

4. The helical type antenna according claim 1, wherein the fractal is of the von Koch type, each straight line whereof being replaced by a sinusoidal segment.

5. The antenna according claim 1, wherein each of the radiating strands consist of a specified metal-clad zone, coiled in a helix on the lateral surface of a sleeve, such that the director axis of each strand is separated from the axis of the following strand by a specified distance, defined along any perpendicular to any director line of the sleeve as the distance between two points, each defined by an intersection between the axis of a strand and a perpendicular to any director line of the sleeve.

6. The antenna according to claim 1, wherein the rotational shape is cylindrical or conical.

7. The antenna according to claim 1, wherein the antenna includes four identical radiating strands.

* * * * *